United States Patent [19]

Brice et al.

[11] Patent Number: 4,699,794

[45] Date of Patent: Oct. 13, 1987

[54] COFFEE BREWING METHOD AND APPARATUS

[76] Inventors: Michael F. Brice, 14 Donna Ln., Syosset, N.Y. 11791; Gaetano A. Natoli, 23 Days Ave., Suffolk, N.Y. 11784

[21] Appl. No.: 638,663

[22] Filed: Aug. 7, 1984 (Under 37 CFR 1.47)

Related U.S. Application Data

[63] Continuation-in-part of Ser. No. 504,155, Jun. 14, 1983, Pat. No. 4,465,697.

[51] Int. Cl.[4] ..... A23F 5/26; B65B 29/02

[52] U.S. Cl. ..... 426/79; 99/287; 99/295; 99/316; 99/321; 426/80; 426/82; 426/77; 426/433

[58] Field of Search ..... 426/77-84; 99/287, 323, 295, 316, 321, 322; 206/0.5

[56] References Cited

U.S. PATENT DOCUMENTS

| | | | |
|---|---|---|---|
| 100,880 | 3/1870 | Fitch et al. | 99/323 |
| 214,617 | 4/1879 | Brown . | |
| 257,641 | 5/1882 | Beebe | 99/323 |
| 473,626 | 4/1892 | Hennig . | |
| 569,678 | 10/1896 | Stephens et al. . | |
| 786,666 | 4/1905 | McKenzie . | |
| 1,127,780 | 2/1915 | Konar | 99/323 |
| 1,489,806 | 4/1924 | Anderson . | |
| 1,668,454 | 5/1928 | Hake | 99/287 |
| 2,034,956 | 3/1936 | Pfeiffer | 99/323 |
| 2,123,054 | 7/1938 | Lamb et al. . | |
| 2,133,166 | 10/1938 | Fritsche . | |
| 2,187,417 | 1/1940 | Doble . | |
| 2,291,060 | 7/1942 | Schiess . | |
| 2,291,278 | 7/1942 | Cleaves . | |
| 2,291,702 | 8/1942 | Downes . | |
| 2,631,522 | 3/1953 | Joy | 99/287 |
| 2,858,762 | 11/1958 | Wade et al. | 99/287 |
| 3,102,465 | 9/1963 | Montesand . | |
| 3,154,418 | 10/1964 | Lovell et al. . | |
| 3,193,388 | 7/1965 | Conrey | 426/80 |
| 3,257,212 | 6/1966 | Kasket . | |
| 3,354,812 | 11/1967 | Gorton | 99/323 |
| 3,556,392 | 1/1971 | Robin . | |
| 3,607,302 | 9/1971 | Beck . | |
| 3,654,852 | 4/1972 | Rosan | 99/323 |
| 3,833,740 | 9/1974 | Schmidt | 426/80 |
| 3,935,318 | 1/1976 | Mihailide . | |
| 3,946,652 | 3/1976 | Gorin . | |
| 4,211,156 | 7/1980 | Zimmermann . | |
| 4,215,628 | 8/1980 | Dodd . | |
| 4,229,481 | 10/1980 | Fornari . | |
| 4,278,691 | 7/1981 | Donarumma et al. . | |
| 4,290,521 | 9/1981 | Mitchell . | |
| 4,306,492 | 12/1981 | Zimmermann . | |
| 4,338,338 | 7/1982 | Popkes . | |
| 4,410,550 | 10/1983 | Gaskill . | |
| 4,465,697 | 8/1984 | Brice et al. | 426/82 |
| 4,471,689 | 9/1984 | Piana | 426/77 |

FOREIGN PATENT DOCUMENTS

| | | | |
|---|---|---|---|
| 242226 | 3/1911 | Fed. Rep. of Germany . | |
| 2155415 | 5/1973 | Fed. Rep. of Germany . | |
| 1111304 | 9/1954 | France | 99/323 |
| 1601335 | 10/1981 | United Kingdom | 426/77 |

*Primary Examiner*—Steven Weinstein

*Attorney, Agent, or Firm*—Antonelli, Terry & Wands

[57] ABSTRACT

An improved method of brewing coffee and a device therefor are disclosed. The method involves the steps of providing a coffee brewing device having a porous housing containing a supply of ground coffee and having a self-supporting handle dimensioned to be hand-held attached thereto for positioning and stirring the housing in a liquid, the housing also including a vent for venting gases from an interior portion of the housing, the gases being generated during brewing, at least partially submerging the housing in the liquid and stirring the housing in the liquid using the handle to produce a flow of liquid in the housing, and controlling the flow of liquid produced within the housing to create turbulence therein to agitate the ground coffee while the generated gases are being vented from the housing by the vent for rapid brewing of the coffee. The turbulence is created by changing the direction of the flow within the housing using baffles positioned inside or on a side of the housing and/or by providing a flexible porous side wall of the housing which can flutter during stirring, that is, can move a substantial distance inwardly and outwardly with respect to the adjacent housing during stirring to create turbulence in the liquid flow within the housing to agitate the ground coffee. Another manner of creating turbulence includes the provision of irregular surfaces on the housing sidewall and/or baffle to disrupt laminar flow thereby creating a turbulent state.

23 Claims, 16 Drawing Figures

FIG. 5.
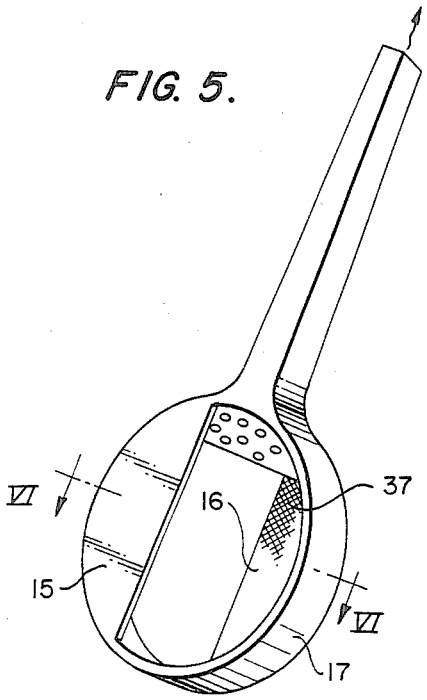
FIG. 6.
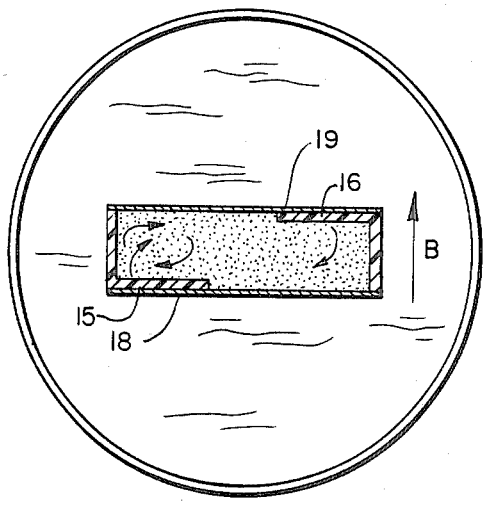
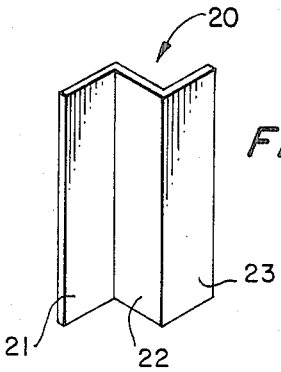
FIG. 7A.
FIG. 7B.
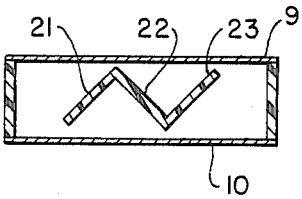
FIG. 8.
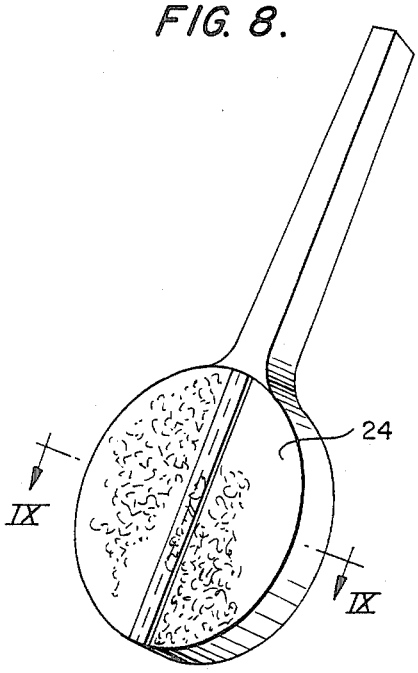

FIG. 9.
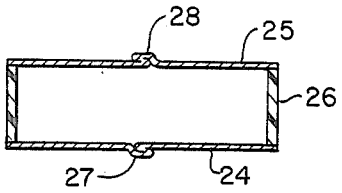
FIG. 10.
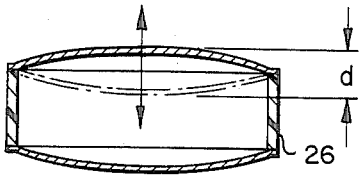
FIG. 11A.
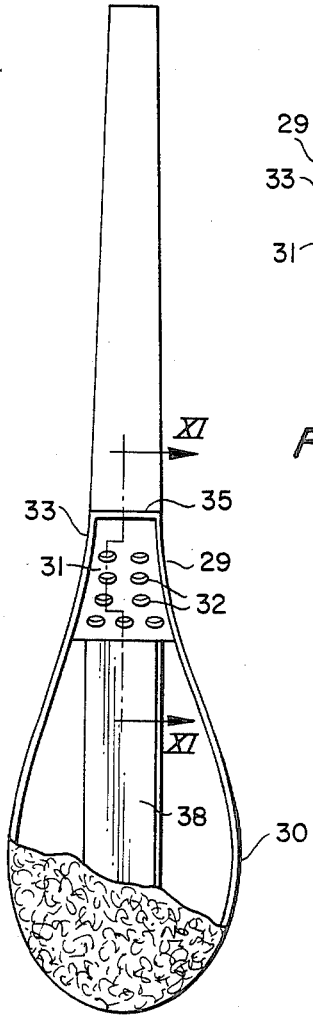
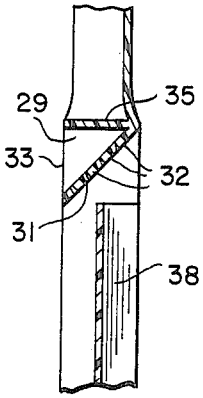
FIG. 11B.
FIG. 12A.
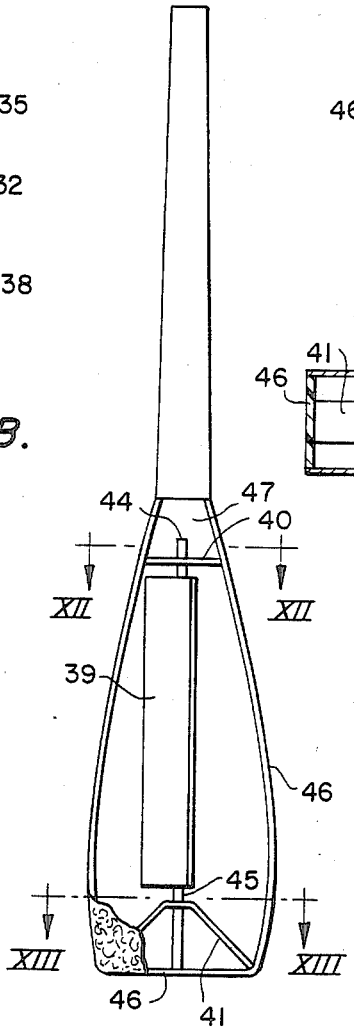
FIG. 12B.
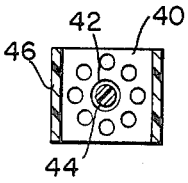
FIG. 12C.
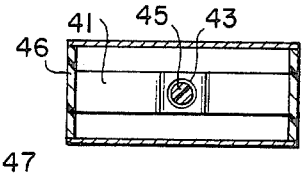

COFFEE BREWING METHOD AND APPARATUS

REFERENCE TO RELATED INVENTION

This application is a continuation-in-part of application Ser. No. 504,155, now U.S. Pat. No. 4,465,697, filed June 14, 1983 for COFFEE BREWING APPARATUS AND METHOD.

BACKGROUND AND SUMMARY OF THE INVENTION

The present invention relates to an improved method of brewing coffee and a coffee brewing device therefor. More particularly, the invention is directed to a method of brewing coffee and a coffee brewing device wherein the device is hand-held by means of a self-supporting handle thereon while a porous coffee containing portion of the device is at least partially submerged in a brewing liquid and stirred to brew a single cup of coffee with an improved extraction efficiency and, hence, in a relatively short brewing time.

Heretofore, many devices and methods have been proposed for brewing ground coffee one cup at a time. For example, in U.S. Pat. No. 2,123,054, a bag-like, coffee retaining receptacle is disclosed. The brewing time required with this device is indicated as five to eight minutes. The patentees state that the device can be gently vertically agitated in the cup to produce a cup of coffee in a shorter period of time. In one embodiment, an inner circulating element in the form of a perforated conical hollow body is employed within the ball-like receptacle. This hollow body allegedly exposes the body of coffee more quickly to the water to produce a quicker action in the making of coffee. Notwithstanding, applicants have found that the time required for brewing coffee with such a device is still on the order of several minutes or more, even when the device is agitated vertically in the manner indicated by the patentees. The coffee produced after such a period with this type of device may also lack the full bodied flavor and aroma one normally expects from a good cup of brewed coffee. The temperature of the coffee may also be less than "hot" when long brewing times are required, especially where cream is added to the coffee. Other devices which have been proposed are shown in U.S. Pat. Nos. 3,154,418 and 4,215,628, and in British Patent No. 1,601,335.

It is also known to provide such devices with special arrangements for forcing water through the coffee-retaining brewing device. For example, U.S. Pat. No. 3,607,302 discloses a conically shaped flow-through type coffee bag which is repeatedly dipped in water to force water through the bag as the bag is pulled upwardly. In a similar manner, the bag in U.S. Pat. No. 4,278,691 is pulled upwardly and lifted out of the cup so that water captured in a reservoir portion of the apparatus moves downwardly through the coffee receptacle portion of the apparatus. Another apparatus is disclosed in U.S. Pat. No. 3,935,318 wherein water is circulated through the device by creating a pumping action or forced circulation with oscillatory movement of a flexible upper membrane of the device. Water flows in and out of the device through perforations in the lower surface thereof. A further example of an apparatus for making a coffee beverage using a pump-like action is disclosed in U.S. Pat. No. 4,211,156.

The pumping or other special arrangements of the aforementioned known devices are provided with a view toward enhancing the efficiency of the brewing process and therefore reducing the brewing time. However, such devices may still require a considerable period of time to brew a cup of coffee from ground coffee and the flavor of the coffee may be found lacking. These devices are also disadvantageous in that their construction is relatively complex. The necessity of having to pump or otherwise specially manipulate the devices to effect brewing is also something that the consuming public can find unacceptable or impractical in a device for conveniently producing a cup of brewed coffee.

More recently, in U.S. Pat. No. 4,410,550, an apparatus and method for making a beverage are disclosed wherein the extraction is reportedly improved by mixing coffee with water using air agitation of the coffee. The device requires the user to blow on a conduit in the form of a common drinking straw which is connected to a porous, coffee containing chamber. While relatively simple in design, one drawback with this type of device is that it requires the user to blow with his or her mouth into the air tube to agitate the coffee for brewing. This exposes the user's mouth and face to possible scalding or burning from the hot water contained in the drinking cup, and, in itself, may be an uncomfortable and unacceptable manner of producing a cup of coffee.

Thus, there continues to be a need for an improved coffee brewing device and method which can be used to quickly and inexpensively produce a cup of good, hot coffee in a manner which is comfortable, safe and readily acceptable to the consuming public.

Accordingly, an object of the present invention is to provide an improved method and device for brewing coffee, one cup at a time, which enable rapid brewing of ground coffee without necessitating the use of special pump devices or other relatively complex, possibly costly and impractical arrangements. An additional object of the invention is to provide an improved method and device for rapidly brewing ground coffee, one cup at a time, which enable the user to produce a cup of coffee in a manner which is comfortable and safe to the user.

A further object of the invention is to provide an improved method of brewing coffee and a coffee brewing device which are simple and inexpensive while, at the same time, providing a high extraction efficiency during brewing and, hence, a rapid brewing of a good, aromatic, flavorful and hot cup of coffee from ground coffee. More particularly, it is an additional object of the present invention to provide an improved coffee brewing method and coffee brewing device which are useful to produce a flavorful cup of coffee in a relatively short period of time, such as within 40–60 seconds, which method merely requires the user to stir the device in the liquid in a manner which is comfortable and safe to the user.

These and other objects of the present invention are attained by a preferred method of brewing coffee of the invention which comprises the steps of providing a coffee brewing device having a porous housing containing a supply of ground coffee with a self-supporting handle dimensioned to be hand-held attached to the housing for positioning and stirring the housing in a liquid to effect brewing of the coffee and wherein the housing further includes vent means for venting gases from an interior portion of the housing during brewing, at least partially submerging the housing in the liquid and stirring the housing in the liquid using the handle to produce a flow of the liquid within the porous housing, and controlling the flow of liquid produced within the housing to create turbulence therein to agitate the ground coffee while venting gases generated the brewing from an interior portion of the housing through the vent means for rapid brewing of the coffee. According to the several disclosed embodiments of the invention, the step of controlling the flow of liquid produced within the housing by the stirring involves interacting the flow in the housing with at least one element connected to the housing to create turbulence in the liquid flow to agitate the ground coffee for rapid brewing. Creating turbulence in the detained water volume to agitate the coffee grounds while venting the gases within the housing enhances the water contact with the coffee grounds and increases the extraction rate of the ground coffee so that a flavorful and aromatic coffee beverage can be produced in a relatively short period of time, such as 40–60 seconds.

According to one disclosed embodiment of the invention, the step of controlling the flow of liquid to create turbulence therein includes changing the direction of the liquid flow in the housing by providing at least one baffle in the flow path of the liquid. Another technique of the invention which may be used to create turbulence in the flow of liquid within the housing includes changing the direction of the liquid flow in the housing by providing the housing with at least one porous wall which can move a substantial distance inwardly and outwardly with respect to adjacent portions of the housing during the stirring. The fluttering or sudden movement of the porous wall which occurs when there is a change in the stirring direction creates a turbulence in the liquid flow within the housing for agitation of the coffee grounds. A still further manner of effecting turbulence is achieved by providing an irregular surface on the baffle and/or housing side wall to disrupt the laminar flow.

A preferred form of the improved coffee brewing device of the invention comprises a housing containing a supply of ground coffee, the housing being at least partially submersible in a liquid to effect brewing of the coffee, a self-supporting handle dimensioned to be hand-held attached to the housing for facilitating positioning and stirring of the housing in the liquid, the housing including at least one porous wall which permits the liquid to enter the housing when the housing is submerged at least partially in the liquid and vent means for venting gases from an interior portion of the housing, the gases being generated during brewing, and wherein the housing includes means for controlling a liquid flow produced in the housing during stirring to create turbulence therein to agitate the ground coffee while the gases are being vented from an interior portion of the housing by the vent means for rapid brewing of the coffee.

According to one disclosed embodiment of the device, the means for controlling the liquid flow includes at least one baffle which is connected to the housing and which extends transversely to a direction of flow induced in the housing during stirring for changing the direction of the liquid flow. More particularly, the baffle extends essentially vertically from a lower portion to an upper portion of the housing. The surfaces of the baffle are arranged at an acute angle with respect to the directions of liquid flow produced in the housing during a back and forth stirring motion of the device. These surfaces of the baffle interact with the liquid flow within the housing to change its direction and create turbulence therein to agitate the ground coffee for rapid brewing. The vertically extending baffle defines a pair of at least partially closed compartments within the housing which contain and retain coffee during brewing.

In another form of the device, the baffle is positioned on a side of the housing. More particularly, a pair of baffles are provided on opposite sides of the housing in laterally staggered relationship. Liquid flow produced within the housing during the stirring is caused to interact with these baffles to change the direction of the liquid flow and cause a turbulence therein to agitate the coffee for rapid brewing.

According to a further form of the device, the baffle is asymmetrically rotatably supported within the housing so that the stirring movement of the device causes the baffle to rotate. This creates turbulence in the detained water volume within the housing to agitate the ground coffee for rapid brewing.

The means for controlling the liquid flow to create turbulence according to another embodiment of the device of the invention includes forming the at least one porous wall of the housing of a flexible porous material which is supported on the housing so as to be movable a substantial distance inwardly and outwardly with respect to the adjacent housing during stirring to create turbulence in the liquid flow within the housing to agitate the ground coffee for rapid brewing. In a disclosed form, the porous wall is provided with at least one fold therein so that the porous wall expands a predetermined amount in response to pressure exerted thereon during brewing by generated gases, by expansion of the coffee grounds, and by water pressure from stirring. The porous wall in its expanded state is movable a substantial distance inwardly and outwardly with respect to the adjacent housing during stirring. It is this fluttering movement of the porous wall which occurs with changes in the stirring direction that creates turbulence in the detained liquid within the housing.

The extraction rate of the aromatic and flavor components of the coffee is increased by the turbulence created agitation of the ground coffee which results from these respective features of the invention. Although vent means for venting generated gases from an interior portion of the housing need not be provided in a device according to the invention, it has been found that the efficiency of the brewing process with a device of the invention can be further increased if such a vent means is provided. Water contact with the grounds is facilitated by permitting the generated gases to readily escape the portion of the housing containing the coffee grounds. In one form of the invention, a vent means is formed in the handle of the device and includes a conduit extending through an axial length of the handle. The conduit establishes fluid communication between the interior portion of the housing and the surrounding atmosphere.

The vent means according to another form of the invention includes a vent chamber provided in an upper portion of the housing from which generated gases can readily escape. A wall is provided in the housing for preventing the supply of ground coffee from moving into the vent chamber during brewing. The wall is perforated to permit the gases to flow through the wall into the vent chamber, while substantially preventing a flow of the supply of ground coffee into the vent chamber.

The plane of the wall is preferably inclined at an acute angle with the longitudinal direction of the device with the wall being located at a distance from the lower end of the device such that the wall is at least partially above the water level during stirring.

In the several illustrated embodiments of the invention, the housing of the device includes opposed relatively narrow side walls with opposed relatively wide walls of the housing extending intermediate the narrow side walls. At least a substantial portion of each of the wide walls is porous to permit liquid permeation through the housing during stirring. The porous walls of the housing are constructed of porous filter paper, which allows liquid to permeate or be absorbed into the housing but which retains the particles of ground coffee in the housing. The relatively narrow side walls of the housing are formed of an impermeable, thin flexible plastic material which tends to retain its shape in the boiled water during stirring but, once the brewing device has been utilized to brew coffee, is sufficiently flexible that it can be removed from the coffee and squeezed with the fingers to drain coffee from the interior of the housing without scalding or burning the fingers.

These and other objects, features and advantages of the present invention will become more apparent from the following description when taken in connection with the accompanying drawings which show, for purposes of illustration only, several embodiments in accordance with the invention.

BRIEF DESCRIPTION OF THE DRAWINGS

FIG. 5 is a perspective view of a second embodiment of the coffee brewing device of the invention;

FIG. 6 is a cross-sectional view of the device of FIG. 5 taken along the line VI—VI;

FIG. 7A is a perspective view of a baffle for a third embodiment of a coffee brewing device according to the invention;

FIG. 7B is a cross-sectional view similar to FIGS. 4 and 6, but showing a device of the invention provided with a baffle as shown in FIG. 7A;

FIG. 8 is a perspective view of another embodiment of the coffee brewing device of the invention;

FIG. 9 is a cross-sectional view of the device of FIG. 8 taken along the line IX—IX;

FIG. 10 is a cross-sectional view of the device of FIG. 9 showing the expandable porous walls thereof in their expanded state wherein they can move inwardly and outwardly a substantial distance during stirring;

FIG. 11A is a side view of a further embodiment of the invention wherein the gases are vented by way of a vent chamber provided in an upper portion of the housing of the device;

FIG. 11B is a cross-sectional view of the vent chamber of the device of FIG. 11A taken along the line XI—XI;

FIG. 12A is a side view of another embodiment of the invention wherein the baffle is asymmetrically, rotatably supported within the housing;

FIG. 12B is a cross-sectional view of the device of FIG. 12A along the line XII—XII and showing the vent chamber wall and rotatable support for the upper end of the asymmetric baffle; and FIG. 12C is a cross-sectional view of the device of FIG. 12A taken along the line XIII—XIII and showing the lower support for the asymmetric baffle.

DETAILED DESCRIPTION OF THE PREFERRED EMBODIMENTS

Figure 1:
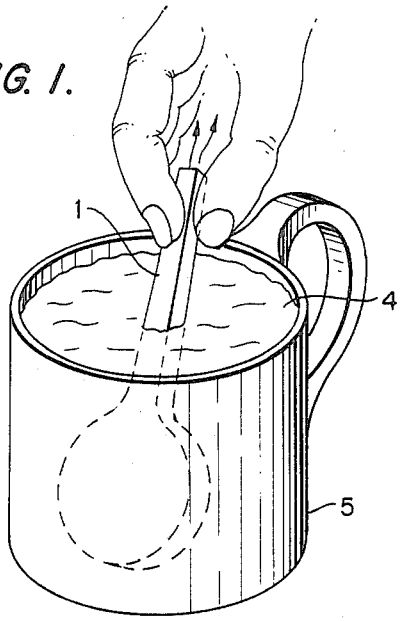
FIG. 1 is a perspective view illustrating the manner of use of each of the embodiments of the present invention.

Referring now to the drawings, and in particular to FIGS. 1-4 thereof, a coffee brewing device 1 according to the invention comprises a housing 2 which contains a supply of ground coffee 3. The housing 2 is adapted to be at least partially submerged in a liquid 4, especially boiling hot water, contained in a cup 5 or the like. A self-supporting handle 6 dimensioned to be hand-held is attached to the housing 2 for facilitating positioning and stirring of the housing in the liquid.

The device 1 is preferably of a continuous integral construction having a relatively narrow, curvilinear side wall 7 and an integrally attached handle 6. The handle is formed with a conduit 8 therethrough for venting gases from the housing to the ambient atmosphere during brewing. Gases are generated in the housing during brewing as a result of the reaction between the ground coffee and hot water, and also because any gas trapped within the housing when it is submerged in the liquid rapidly expands upon being heated by the hot water. By venting these gases, the efficiency of the brewing process is increased since the presence of gas within the housing reduces the area of contact of the brewing liquid with the coffee grounds. The integral side wall 7 of the housing 2 and the handle 6 are preferably formed of an insoluble molded plastic material, such as polypropylene or the like. The side wall and handle are formed of an impermeable material of a sufficient thickness so that the side wall and handle remain substantially free from deformation when immersed in boiling water and stirred. Other materials, such as paper, or metal, which would effectively permit the invention to perform in the manner desired, may also be used.

The housing 2 further includes opposed relatively wide walls 9 and 10 extending intermediate the opposed relatively narrow side walls 11 and 12 defined by the continuous side wall 7. The walls 9 and 10 are formed of a porous material to permit liquid to enter the housing when the device is placed in the brewing liquid. Preferably, the walls 9 and 10 are formed of a porous filter paper, although other insoluble filtering materials, such as gauze or the like, may be successfully utilized where the size of the porous openings in the material permit the brewing liquid to enter the housing while retaining the ground coffee within the housing. The porous material of the walls is connected to the plastic side wall 7 of the housing by heat sealing or other suitable bonding technique. Alternatively, the porous wall could be in the form of a continuous bag which extends around and is supported on the plastic side wall of the housing. The open end of the bag in such an arrangement should be closed about the housing or sealed thereto to prevent the coffee grounds from escaping.

A means 13 in the form of a baffle is provided in the housing 2 for controlling the liquid flow produced within the housing during stirring of the housing in the brewing liquid to create turbulence therein to agitate the ground coffee while the gases are being vented from an interior portion of the housing by vent conduit 8. The single baffle 13 extends essentially vertically within the housing from a lower portion to an upper portion thereof. The baffle 13 is positioned within and connected to the housing 2 so as to extend transversely, and preferably at an acute angle, with respect to the direction of liquid flow produced in the water temporarily detained within housing during a normal back and forth or circular stirring motion of the device in the manner typical of stirring with a spoon, for example.

Figure 4:
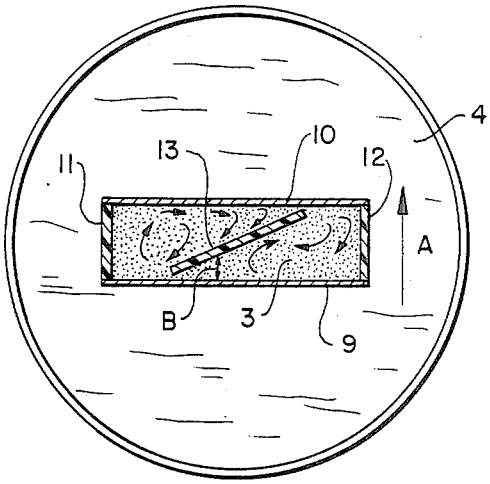
FIG. 4 is a cross-sectional view of the device of FIG. 2 taken along the line IV—IV, and showing the device being stirred in a liquid during brewing in the manner illustrated in FIG. 1.

Referring to FIG. 4, when the device 1 is stirred back and forth along the direction of arrow A, the volume of water retained in the housing moves or flows relative to the device in a direction opposite that of the direction of stirring. The baffle 13 extends essentially completely across the width of the housing, as shown in FIG. 4, to divide the housing into two essentially closed compartments which contain and retain coffee, while enabling gases generated in the compartments during brewing to be vented from the interior of the housing by the vent conduit 8. The baffle 13 is located at an acute angle with respect to the porous walls 9 and 10 of the housing so that it extends transverse to the direction of the liquid flow produced in the housing when the device is stirred back and forth in the cup 5 along the direction of arrow A. As a result of this orientation, the liquid flow in the housing strikes the baffle 13 and its direction of flow is changed to create a turbulence in the liquid flow within the housing to agitate the ground coffee for more rapid brewing thereof. The baffle can be integrally formed with the side wall 7 and handle 6 of a molded insoluble plastic material. The baffle is preferably relatively thin but should have sufficient structural integrity to function to deflect the flow of liquid produced within the housing during stirring. A perforated wall or screen 14 is positioned adjacent the top of the housing 2 over the aperture communicating with conduit 8 in handle 6. The perforations in wall 14 are of a size to permit gases to be vented from the housing to the conduit 8 while retaining coffee therein during brewing. In this way, the coffee grounds will remain in the housing 2 for agitation during brewing and not float up into the conduit 8 of the handle 6.

In the embodiment of FIGS. 5 and 6, a pair of baffles 15 and 16 are provided for changing the direction of the liquid flow in the interior of the housing. The porous walls 18 and 19 of the housing as shown in FIG. 6 are not illustrated in FIG. 5 so that the baffles 15 and 16 and the interior of the housing can be seen. These baffles are preferably formed integrally with the housing side wall 7 and handle 6 as part of the housing. The baffles 15 and 16 are positioned in laterally staggered relationship on opposite sides of the housing. Liquid flowing within the housing 17 as a result of stirring impinges upon the baffles and is redirected, as shown by the arrows in FIG. 6, thereby creating a turbulence in the flow within the housing to agitate the coffee and enhance the brewing efficiency in a manner similar to that described with respect to the embodiment of FIGS. 1–4.

The interior surfaces of the baffles 15 and 16 which contact the liquid flow produced in the housing can be made irregular as shown at 37 by scoring, etching or stepping the surface of the baffle, for example, to increase the resistance to water flow. This further aids in creating turbulence by disrupting the laminar flow along these surfaces. Ihe internal surfaces of the side wall 7 can also be made irregular for this purpose.

Another form of the baffle which may be used in the device of the invention is illustrated in FIGS. 7A and 7B. As shown therein, the baffle 20 is provided with a plurality of planar sections 21–23 arranged in a continuous, pleated configuration. The baffle 20 extends from a lower portion of the housing to an upper portion thereof like the baffle 13 of the embodiment of FIGS. 2–4. As seen in the cross-sectional view of FIG. 7B, the baffle 20 is arranged in the housing so that liquid flow within the housing will impinge upon the planar sections 21–23 of the baffle and be redirected to create a turbulence therein for coffee ground agitation.

Turbulence can also be created in the liquid flow within the housing according to the invention by forming at least one porous wall of the housing of a flexible material which is mounted to the housing so as to be movable a substantial distance inwardly and outwardly with respect to the adjacent housing during stirring. This fluttering of the porous wall creates turbulence in the liquid retained within the housing which agitates the ground coffee for more rapid brewing. An embodiment of this form of the invention is illustrated in FIGS. 8–10 of the drawings, wherein it is seen that the opposed porous walls 24 and 25 of the housing 26, formed of porous filter paper, are each provided with a fold 27, 28 therein which permit the porous walls to expand a predetermined amount in response to pressure exerted thereon during brewing from generated gases and from coffee ground expansion. The porous walls 24 and 25, in their expanded state, are movable a substantial distance d inwardly and outwardly with respect to the adjacent housing 26 during stirring. Thus, when flow is produced within the housing as a result of stirring in a first direction, with reversal of the stirring direction, the forward or leading porous wall will be forced inwardly with respect to the side walls of the housing 26. The sudden movement of the porous wall creates a turbulence in the liquid flow within the housing to agitate the coffee. Preferably, the folds are of sufficient size so that when the walls are expanded they increase the volume within the housing at least 10–15%, and preferably approximately 30%.

This feature of the invention offers the additional advantage of permitting the housing 26 of the device to be more completely filled with ground coffee during manufacture. Thus, for a given amount of coffee, for example 7–8 grams, a more compact device can be realized. This is possible because once the device is inserted into the brewing liquid the porous walls 24 and 25 with folds 27 and 28 therein expand to the condition shown in FIG. 10 to provide additional room to facilitate mixing of the coffee and liquid. Where the porous walls are not expandable the housing of the device is usually filled to no more than approximately 60–70% with ground coffee to allow room for expansion and agitation. But where an additional 30% of housing volume is obtained with expansion of the porous walls, the housing can be more nearly filled with ground coffee in its unexpanded state. Although the flexible porous walls 24 and 25 are initially folded in the embodiment of FIGS. 8–10, it is envisioned that the folds could be eliminated. In such a case, the porous walls could simply be formed with sufficient play therein, as shown in FIG. 10, to permit them to move a substantial distance inwardly and outwardly with respect to the adjacent housing during stirring to create the desired turbulence.

Figure 2:
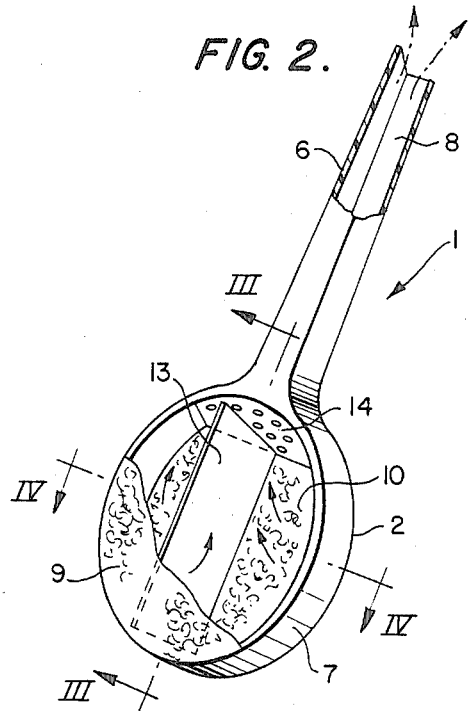
FIG. 2 is a perspective view of a first embodiment of the coffee brewing device of the invention.
Figure 3:
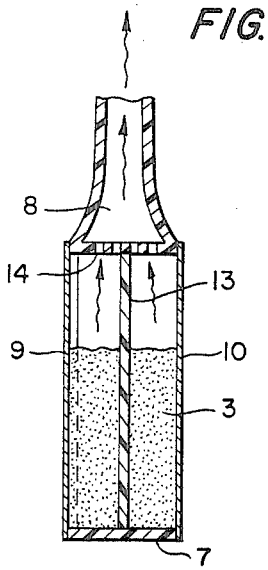
FIG. 3 is a cross-sectional view of the device of FIG. 2 taken along the line III—III.

Of coarse, other fold arrangements than that illustrated could also be employed, as will be readily apparent to the skilled artisan. This expandable or movable wall feature of the embodiment of FIGS. 8–10 can also be employed in combination with one or more baffles of the type shown in FIGS. 2–7. For example, a single vertically extending baffle as shown in FIGS. 2–4 could be employed to achieve the advantageous features of the invention.

The devices illustrated in FIGS. 1–10 of the drawings are provided with a conduit 8 which extends through an axial length of the handle 6 to establish fluid communication between the interior of the housing and a surrounding atmosphere for venting the generated gases. However, in place of the hollow handle, the gases can be vented by a vent in the form of a vent chamber 29 provided in an upper portion of the housing 30 as shown in FIGS. 11A and 11B. An inclined wall or screen 31 is formed in the housing to prevent the supply of ground coffee from moving into the vent chamber during brewing. The wall 31 includes a plurality of perforations 32 for permitting the gases to flow through the wall into the vent chamber, while substantially preventing a flow of the supply of ground coffee into the vent chamber. The vent chamber 29 is defined by the continuous side wall 33 of the housing, an upper wall 35 and also the porous wall 34 on one side of the housing in cooperation with the inclined perforated wall 31 within the housing. The filter paper of the porous wall 34 is preferably sealed to both the lower, outer edge of the perforated wall 31 and side wall 33 of the housing to prevent the ground coffee from entering the vent chamber. During brewing, generated gases can move through the perforated wall from where they are free to pass through the porous filter paper of the housing walls without interference from compacted coffee.

The housing 30 in the embodiment of FIGS. 11A and 11B is elongated as compared with that shown in the previously described embodiments so that the vent chamber is normally located above or at least partially above the water line in a typical cup filled with hot water. By inclining the perforated wall 31 of the vent chamber 29, the device can be used with a range of water depths without submerging the entire vent chamber. It is preferred to have at least a portion of the vent chamber above the water line to prevent coffee from floating up against the entire wall 31. The inclination of the wall 31 provides a greater wall area so that even if the water line is above the vent chamber there is a reduced possibility of complete blockage of the holes in the wall for gases to escape. Also, the filter paper over the vent chamber remains dry above the water line and more porous to escaping gases. A single, angulated, vertical baffle 38 like that in FIGS. 2–4 is employed within the housing beneath the vent chamber 29. A more porous paper could also be used over the vent chamber 29 than on the remainder of the housing to facilitate the escape of generated gases from the chamber. Instead of the baffle 38, or in addition thereto, other turbulence creating means of the invention can be employed with the device of FIGS. 11A and 11B, including the use of an expandable porous wall and/or the provision of irregular surfaces on the housing structure itself. Further, if slower brewing times can be tolerated, the device of this embodiment can simply be used with the novel venting arrangement without the baffle or other turbulence creating means. Wall 31 between the upper portion or vent chamber of the housing and the lower portion of the housing can also be eliminated where the length of the housing is such that at least a portion of the vent chamber will be above the water during brewing.

The device in FIGS. 12A–12C employs a vertical baffle 39 which is asymmetrically rotatably supported at its upper and lower ends by means of support members 40 and 41, respectively. The members 40 and 41 have round openings 42 and 43 therein which receive round pin like projections 44 and 45 extending from the ends of the baffle toward one side thereof. The end 46 of the lower projection 45 rests on the bottom of the housing 46. The support members 40 and 41 are connected to the housing 46. The upper support member is perforated and serves as the lower wall of a vent chamber 47 which is located so as to be above the water line in the typical cup. When the device in this embodiment is stirred the baffle imbalance balance causes it to rotate about its support to create turbulence in the liquid and agitate the ground coffee for rapid brewing.

From the above description of the coffee brewing devices of the invention and their manner of use, it is apparent that the method of brewing coffee of the present invention comprises the steps of providing a coffee brewing device having a porous housing containing a supply of ground coffee with a self-supporting handle dimensioned to be hand-held attached thereto for positioning and stirring the housing in a liquid to effect the brewing of the coffee and wherein the housing may further include vent means for venting gases from an interior portion of the housing, at least partially submerging the housing in the liquid and stirring the housing in the liquid using the handle to produce a flow of the liquid in the porous housing, and controlling the flow of liquid produced within the housing to create turbulence therein to agitate the ground coffee while, in the preferred embodiments, venting gases from an interior portion of the housing, for rapid brewing of the coffee. More specifically, it is seen that the step of controlling the flow of liquid produced within the housing comprises interacting the liquid flow with at least one element connected to the housing to create turbulence in the liquid flow to agitate the ground coffee. According to one form of the invention, the step of effecting the flow of liquid to create turbulence therein includes changing the direction of the liquid flow in the housing by providing at least one baffle in the flow path of the liquid. The baffle can be stationary or asymmetrically rotatably supported for movement during stirring. In addition, or alternatively, the step of controlling the flow of liquid within the housing to create turbulence therein includes changing the direction of the liquid flow in the housing by providing the housing with at least one porous wall which can move a substantial distance inwardly and outwardly with respect to adjacent portions of the housing during stirring. The internal surfaces of the housing can also be made irregular to thereby disrupt laminar flow of liquid along the surfaces for creating turbulence to agitate the ground coffee for rapid brewing.

Thus, by means of the coffee brewing device and method of the invention, it has been found that an aromatic and flavorful cup of coffee can be brewed, one cup at a time, in a relatively short period of time, for example in one minute or less, by simply stirring the device back and forth or otherwise within a cup of freshly boiled water. The relatively short brewing time with the device and method of the invention are a result of the high extraction efficiency which occurs because of the agitation of the ground coffee in the hot water as a result of the turbulence created in the water temporarily detained within the housing. The invention makes use of the flow produced in the water within the housing during stirring and controls this flow to create turbulence therein to accomplish the coffee ground agitation. Venting of generated gases from the housing enhances the efficiency of the process by speeding the water contact with the coffee grounds when brewing is initiated. This result is accomplished in a relatively simple and inexpensive way without necessitating the use of special pump devices or other relatively complex arrangements, and without requiring the user to blow through a straw or otherwise subject himself to risk of scalding or burning.

While we have shown and described several embodiments in accordance with the present invention, it is understood that the same is not limited thereto, but is susceptible of numerous changes and modifications as would be known to those skilled in the art, given the present disclosure. For example, the housing of the device could have other shapes than those illustrated in the disclosed embodiments. Also, the baffles of the device positioned within the housing need not be formed of solid, imperforate material, but could be somewhat porous to redirect a certain amount of flow to create turbulence, while, at the same time, allowing a portion of the liquid impinging upon the baffle to pass through to create a turbulence and agitate the coffee grounds on the opposite side of the baffle. The internal surfaces of the housing side wall and/or various baffles in the embodiments of the invention may also all be formed as irregular surfaces by etching, scoring or other procedures to further enhance the turbulence as illustrated and described with respect to the embodiment of FIGS. 5 and 6. It is also envisioned that the turbulence for agitation of the coffee could be achieved solely by provision of irregular surfaces of the housing in contact with the liquid in the housing to disrupt the laminar flow adjacent these surfaces. For example, a stepped or other irregular configuration of the housing could be employed to attain the desired agitation. In addition, while venting means are preferably employed in the devices of the invention, the means for creating turbulence in the liquid flow in the brewing devices of the invention still provide substantial advantages in the absence of vent means. Thus, the various embodiments of the invention could be employed without the vent means thereof simply for the benefits of the improved brewing obtained by the agitation of the ground coffee by creating turbulence in the liquid flow within the device housing. Thus, we do not wish to be limited to the details shown and described, but intend to cover all such changes and modifications as are encompassed by the scope of the appended claims.

We claim:

1. A method of brewing coffee, comprising the steps of providing a coffee brewing device having a porous housing containing a supply of ground coffee with a self-supporting handle dimensioned to be hand-held attached to said housing for positioning and stirring said housing in a liquid to effect brewing of said coffee and further including vent means for venting gases from an interior portion of said housing during brewing, at least partially submerging said housing in a liquid and stirring said housing in said liquid using said handle to produce a flow of aid liquid within said porous housing, and controlling said flow of liquid produced within said housing during stirring to create turbulence therein to agitate said ground coffee while venting gases during said brewing from an interior portion of said housing through said vent means for rapid brewing of said coffee, wherein said step of controlling the flow of liquid to create turbulence therein includes changing the direction of the liquid flow in said housing by providing at least one baffle connected to said housing so as to move with said housing during stirring, said baffle extending within said housing transversely to a direction of said liquid flow produced in said housing during stirring to produce said turbulence therein.

2. A coffee brewing device for rapidly brewing coffee, said device comprising a housing containing a supply of ground coffee, said housing being at least partially submersible in a liquid to effect brewing of said coffee, a self-supporting handle dimensioned to be hand-held attached to said housing for facilitating positioning and stirring of said housing in said liquid, said housing including at least one porous wall which permits liquid to enter said housing when it is at least partially submerged in said liquid, and vent means for venting gases from an interior portion of said housing during brewing, wherein said housing includes means for controlling liquid flow produced within the housing during stirring of said housing in said liquid to create turbulenece therein to agitate said ground coffee while said gases are being vented from an interior portion of said housing by said vent means for rapid brewing of said coffee, and wherein said turbulence creating means includes at least one baffle which is connected to said housing so as to move with said housing during stirring of said housing in said liquid, said baffle extending within said housing transversely to a direction of liquid flow produced in said housing during said stirring for changing the direction of said liquid flow to produce said turbulence therein.

3. A coffee brewing device according to claim 2, wherein said turbulence creating means includes a pair of baffles for changing the direction of said liquid flow in the interior of said housing, said pair of baffles being positioned in laterally staggered relationship on opposite sides of said housing.

4. A coffee brewing device according to claim 2, wherein said baffle is positioned within said housing and defines a plurality of at least partially closed compartments within said housing which contain and retain coffee.

5. A coffee brewing device according to claim 2, wherein said baffle extends essentially vertically from a lower portion to an upper portion of said housing.

6. A coffee brewing device according to claim 2, wherein said baffle extends inwardly from a wall of said housing.

7. A coffee brewing device according to claim 6, wherein said baffle extends at least essentially completely across the interior of said housing.

8. A coffee brewing device according to claim 2, wherein said vent means is provided in an upper portion of said housing for venting said gases from an interior portion of said housing.

9. A coffee brewing device according to claim 8, wherein said vent means is formed in said handle.

10. A coffee brewing device according to claim 9, wherein said vent means includes a conduit extending through an axial length of said handle, said conduit establishing fluid communication between said interior portion of said housing and a surrounding atmosphere.

11. A coffee brewing device according to claim 8, wherein said vent means includes a vent chamber provided in an upper portion of said housing, wall means being provided in said housing for preventing said supply of ground coffee from moving into said vent chamber during brewing, said wall means including at least one perforation for permitting said gases to flow through said wall means into said vent chamber while substantially preventing a flow of said supply of ground coffee into said vent chamber.

12. A coffee brewing device according to claim 2, wherein said housing includes opposed relatively narrow side walls with opposed relatively wide walls of said housing extending intermediate said narrow side walls, at least a substantial portion of each of said wide walls being porous to permit liquid to enter said housing when submerged in said liquid.

13. A coffee brewing device according to claim 2, wherein said housing further includes opposed, relatively impermeable side wall portions formed of thin flexible material whereby once the brewing device has been utilized to brew coffee it can be removed from the coffee and the housing squeezed with the fingers placed at said impermeable side wall portions to drain coffee from the interior of said housing without burning said fingers.

14. A coffee brewing device according to claim 13, wherein said relatively impermeable side wall portions of said housing are formed of a thin plastic material.

15. A coffee brewing device according to claim 13, wherein said opposed, relatively impermeable side wall portions are relatively narrow with opposed relatively wide porous walls of said housing extending intermediate said side wall portions.

16. A coffee brewing device according to claim 2, wherein said at least one porous wall is constructed from porous filter paper.

17. A coffee brewing device according to claim 2, wherein said at least one porous wall includes a pair of opposed porous walls.

18. A coffee brewing device according to claim 2, wherein said housing further includes a wall portion having a shape retaining character in boiled water to lend structural support to said housing, said at least one porous wall being supported by said wall portion.

19. A coffee brewing device according to claim 2, wherein said vent means includes a vent chamber provided in an upper portion of said housing for venting gases from an interior portion of said housing during brewing.

20. A coffee brewing device according to claim 19, wherein said housing has a length in its vertical direction during use such that at least a portion of the vent chamber therein is normally above the water line during brewing of coffee in a coffee cup.

21. A coffee brewing device according to claim 19, wherein a perforated wall is provided between the vent chamber and a lower portion of said housing containing said ground coffee to prevent ground coffee from entering said vent chamber during brewing, said perforated wall being vertically inclined to permit brewing in a range of water depths without having floating coffee contacting said wall and to thereby present a relatively large perforated surface area for venting said gases.

22. A coffee brewing device according to claim 19, wherein said vent chamber vents gases out of the side of the device above the water line.

23. A coffee brewing device according to claim 22, wherein said gases are vented through said at least one porous wall.

* * * * *